US005217228A

United States Patent [19]

De Aguilar

[11] Patent Number: 5,217,228

[45] Date of Patent: Jun. 8, 1993

[54] GOLF CLUB INCLUDING LIGHT BEAM ORIENTING DEVICE

[76] Inventor: Juan De Aguilar, 37, Avda. Castañeda, Santander, Spain, 39012

[21] Appl. No.: 833,722

[22] Filed: Feb. 11, 1992

[30] Foreign Application Priority Data

Feb. 11, 1991 [ES] Spain ..... 9100349
Jan. 23, 1992 [ES] Spain ..... 9200144

[51] Int. Cl.[5] ..... A63B 69/36

[52] U.S. Cl. ..... 273/186.3; 273/194 R; 273/35 A; 273/187.4

[58] Field of Search ..... 273/186 A, 186.3, 194 R, 273/35 A, 186.2, 187.4

[56] References Cited

U.S. PATENT DOCUMENTS 3,953,034 4/1976 Nelson ..... 273/186.3
4,341,384 7/1982 Thackrey ..... 273/186 AA
4,930,785 6/1990 Mills ..... 273/194 R X
5,029,868 7/1991 Cloud ..... 273/186.3

*Primary Examiner*—George J. Marlo
*Attorney, Agent, or Firm*—Wenderoth, Lind & Ponack

[57] ABSTRACT

A golf club is provided internally with a light generator, preferably a laser generator, capable of generating a light beam in a path parallel to the theoretical path of a ball after being struck by the club. The generator is located within a grip of the club, within which also is a push button to activate the generator, and emits a beam of light that travels axially down the inside of the club until it reaches a mirror causing its path to be bent so that the beam of light exits to the outside via an opening formed in the club. The angular position of the mirror can be adjusted from the outside by means of a corresponding control.

14 Claims, 2 Drawing Sheets

GOLF CLUB INCLUDING LIGHT BEAM ORIENTING DEVICE

BACKGROUND OF THE INVENTION

This invention relates to certain improvements to a conventional golf club, particularly to allow a player to orientate the position of his body correctly and hence to achieve a proper orientation of the club with respect to the ball in his approach to a target and to holing of the ball.

As is well known, playing golf and, more specifically, each shot, involves a multitude of factors such as the characteristics of the course, the speed and direction of the wind, type of club used and, fundamentally, the characteristics of the impact given by the player to the ball.

Obviously, variables such as the characteristics of the course or the ambient wind are totally unalterable. On the other hand, considering the different kinds of clubs employed, specifically fourteen allowed clubs with different characteristics of head as well as construction and shape, there are specific requirements in terms of the type of club to use for each type of shot. This requires a long period of learning.

The real problem focuses on the characteristics of the impact imparted to the ball in each case with regard to direction, magnitude of impact, etc. This requires a long period of learning, particularly because of the influence of the above variables, that are not understood by the novice player who, for example, on many occasions blames a poor shot on a determining factor different from the one that really caused the poor shot. Consequently, this makes the learning process difficult when account is taken of the great number of variables that are involved in the game.

SUMMARY OF THE INVENTION

As indicated above, the improvements of the invention are intended in some degree to facilitate learning of the game of golf, specifically allowing a player to detect with absolute assurance the direction in which he is aiming the club at each moment.

This is achieved according to the invention by providing in a golf club a light-beam generator, in such a way as to generate a beam of light from the club parallel to the theoretical path of the ball after impact by the club.

More specifically, at least a majority of the golf club is hollow, into which coaxially fits a laser generator, through an end of the club opposite to the head thereof. Positioned at a suitable point within the club is a reflector mirror. The club has an outlet opening for the beam of light. The mirror can be adjusted to a proper position so that correct parallelism with the theoretical path of the ball can be achieved. The reflector mirror is suitably secured by appropriate means within the club itself, as is the laser generator. The generator may be embedded in a grip of the club, along with a push-button at a position such that it can be easily triggered in the normal stance of gripping the club at the moment of striking or hitting the ball.

BRIEF DESCRIPTION OF THE DRAWINGS

In order to better understand the invention, the following description is with reference to the accompanying drawings which are illustrative and not restrictive, and wherein.

DETAILED DESCRIPTION OF THE INVENTION

With reference to the drawings, it will be seen that a golf club in accordance with the present invention includes, as an conventional golf club, an elongated body or shaft 1, at one end of which is a head 2 that is intended to strike a ball, and at the other end of which is a grip 3.

Figure 2:
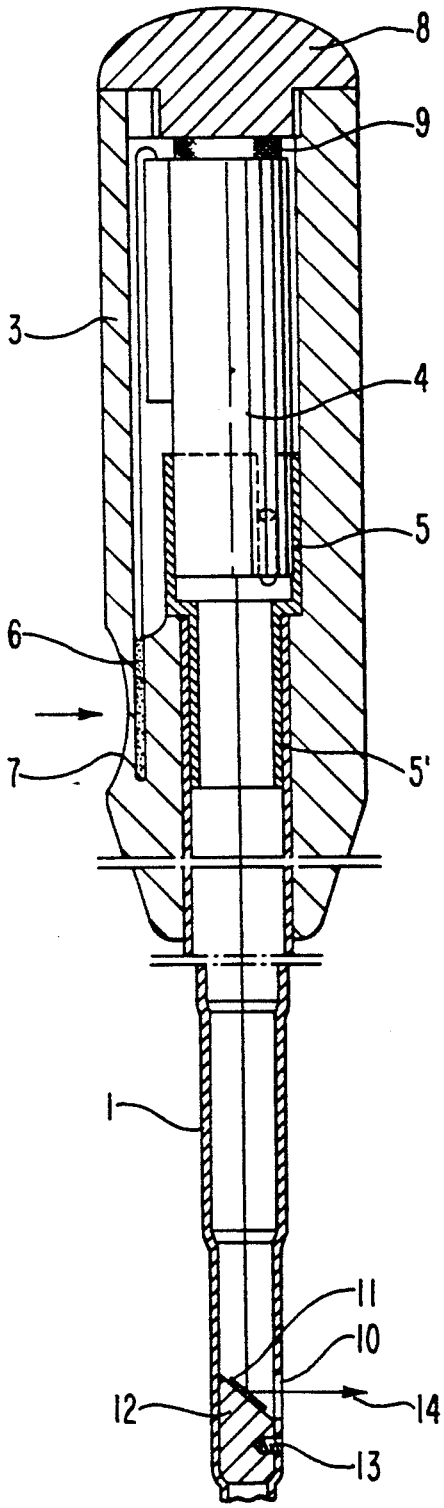
FIG. 2 is an enlarged longitudinal cross-sectional view specifically showing those parts of the club affected by the improvements of the invention.

Starting from this basic design, the invention provides that the body or the shaft 1 has a hollow, possibly widened at the end fitting with grip 3 and into which fits a laser generator 4 that is secured by being plugged into the shaft 1. This is achieved with the aid of a collar having two sections of different diameter, i.e. a receiver section 5 for the laser generator 4 and a smaller section 5' that can be plugged into the mouth or upper end of the body 1. This entire unit is embedded within the grip 3, as can be seen particularly in FIG. 2, as is a push-button 6 for triggering the laser generator 4, which occupies a suitable position within the grip 3 to confront a window or weakened mouth 7 that allows the push-button to be directly activated by a hand of the user in order to trigger the generator 4 by a corresponding electric cell. For this purpose, the grip 3 is provided with a stopper or bung 8 acting on a bung 9 of the laser generator 4 to enable replacement of the cell.

The shaft also has at a central part thereof a lateral opening or window 10 through which emerges a laser beam 14 to the outside after having been bent through an appropriate angle, e.g. a right angle, by means of a mirror 11 fitted in the hollow cavity of the body 1, e.g. by a supporting wedge 12 fixed to the shaft by a stud 13, or by any other suitable means. Mirror 11 must adopt a highly precise position with respect to the orientation of the club head 2 so that the direction of the light beam 14 when the push-button 6 is triggered is correct. In other words, the path of beam of light 14 has to be parallel to an imaginary vertical plane passing along the path followed by the ball when it is struck by the club head.

Obviously, the practical implementation of the invention as above described and as shown in the drawings corresponds to a particular solution which, although regarded as being preferred, does not leave out of the invention the use of any other type of light generator or any other type of positioning thereof in the club.

Figure 1:
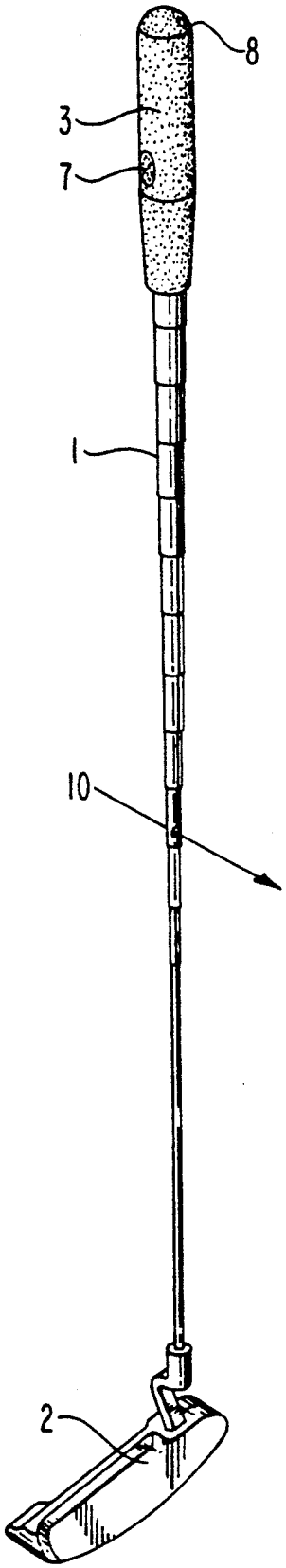
FIG. 1 is a perspective view of a golf club in accordance with the present invention.

It must also be pointed out that the putter shown in FIG. 1, i.e. a club with a metal head intended for holing a ball already on a green, in other words close to the hole, provides a special application of the invention, since the shot (i.e. putt) can be controlled by the light beam striking the actual pole or the flag marking the hole. The invention is equally applicable to any other type of club, both those intended for short shots and those used for long shots, or for irons and for woods.

Figure 4:
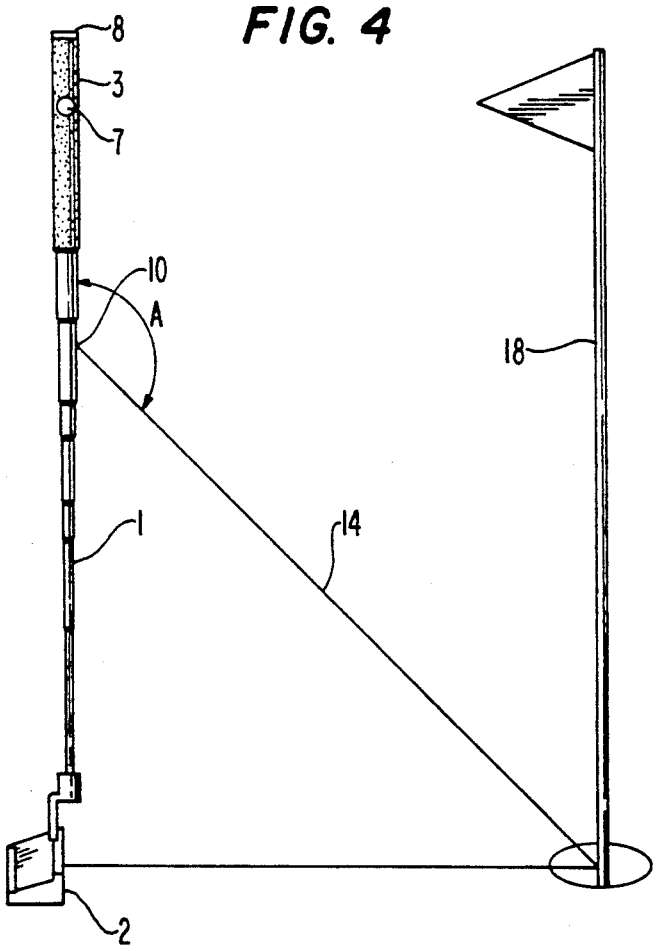
FIG. 4 is a diagrammatic view showing practical use of the golf club.

Although it is indicated above that the angle of reflection defined by the position of the mirror 11 may be 90°, this angle can be modified to any other that is considered suitable and convenient, for example such as that shown in FIG. 4 wherein the angle A is considerably greater than 90°.

Figure 3:
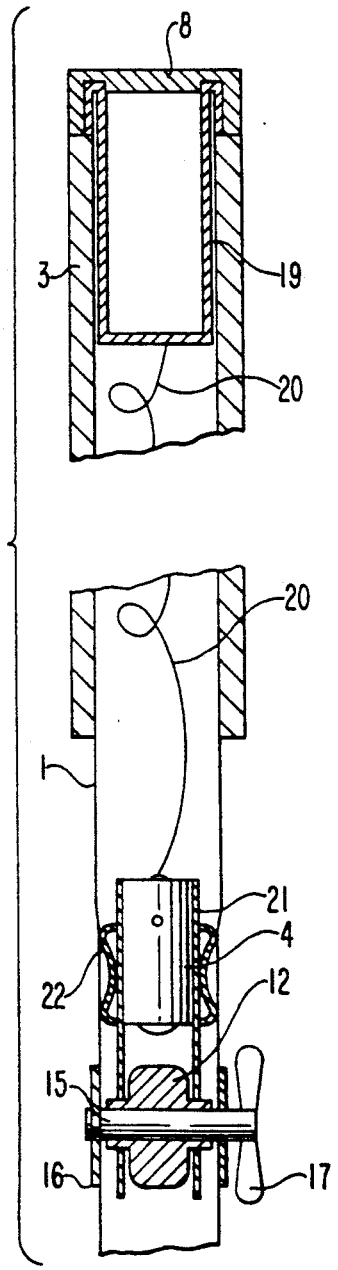
FIG. 3 is a similar view of a modified embodiment wherein orientation of a mirror can be modified.

In accordance with the modification of the invention shown in FIG. 3, instead of being fixed to the body 1 by means of the stud 13, the wedge 12 supporting the mirror 11 has smaller dimensions and is mounted on a rod 15 that extends across body 1, rod 15 being suitably secured to the latter by means of metal pieces 16 that act as facings making it impossible for rod 15 to turn accidentally. One end of shaft 15 has a control or orientating element 17 that allows the angular position of the mirror 11 to be adjusted at will, so that the angle A made by the reflected light beam 14 as it exits the golf club consequently also can be adjusted at will.

In accordance with the above, and also as can be seen in FIG. 4, when the reference point chosen by the player is close, for example the flag 18, angle A will be markedly oblique, while angle A decreases as the distance from the reference point increases, angle A progressively becoming closer to 90°.

In the embodiment of the invention shown in FIG. 3, a different system has been provided for introducing the elements of the device into the club. Thus, situated immediately below the bung 8 is a housing 19 that is physically independent of the laser generator and the purpose of which is to receive the feed cell for the generator, while the laser generator 4 itself is substantially displaced with respect to housing 19 and is connected thereto by a wire 20. More specifically, laser generator module 4 is mounted within a sleeve 21 that in turn forms the support for the rod and wedge 15, 12, in turn supporting the mirror 11. Sleeve 21 is suitably stabilized in the cavity of the body 1 of the club by metal side pieces 22 and by the mirror-adjustment rod 15 itself.

It is not considered necessary to enlarge on this description further, since one skilled in the art will understand the scope of the invention and the advantages achieved thereby.

The materials, shape, size and arrangement of the elements are capable of variation, always provided that the essential nature of the invention is not changed. The terms employed herein are intended to be used in their broadest sense and not to be regarded as limiting.

I claim:

1. In a golf club including a shaft, a head at a first end of said shaft and a grip at a second end of said shaft, the improvement comprising:

said shaft including a hollow axial length portion having therethrough a lateral opening located approximately at a midportion of the length of said shaft; and means connected to said club for, upon said club being oriented in a position to strike a golf ball, generating a beam of light extending in a direction substantially parallel to a theoretical path of flight of the golf ball if the golf ball were to be struck by said head when said club is oriented in said position, such that said beam of light may be employed by a user of said club as a sight for controlling the direction in which said club is aimed, said means comprising:

a light beam generator positioned to direct said beam of light downwardly through said hollow axial length portion of said shaft;

a mirror, positioned within said hollow axial length portion of said shaft at a location adjacent said opening, for reflecting said downward beam of light from said generator laterally through said opening; and means, operable outwardly of said shaft, for selectively adjusting the orientation of said mirror relative to said shaft and thereby the angle of said beam of light reflected through said opening.

2. The improvement of claim 1, wherein said generator comprises a laser generator.

3. The improvement of claim 1, wherein said generator is positioned within said grip.

4. The improvement claimed in claim 3, wherein said second end of said shaft is open, and said generator is supported at said open second end.

5. The improvement claimed in claim 4, further comprising a collar having a larger tubular section and a smaller tubular section, said smaller tubular section fitting within said open second end of said shaft, said generator being supported in said larger tubular portion, and said grip enclosing said collar.

6. The improvement claimed in claim 5, wherein said grip has a removable end plug, thus enabling said collar and said generator to be inserted into and removed from said grip.

7. The improvement claimed in claim 1, further comprising means, located at a position to be operated by the user during normal use of said club, for activating said generator.

8. The improvement claimed in claim 7, wherein said activating means is embedded in said grip.

9. The improvement claimed in claim 8, wherein said grip includes a window or reduced thickness portion to enable the user to operate said activating means during normal gripping of said grip.

10. The improvement claimed in claim 7, wherein said activating means comprises a push button.

11. The improvement claimed in claim 1, wherein said generator is positioned axially relative to said shaft.

12. The improvement claimed in claim 1, wherein said adjusting means comprises a support member supported within said hollow shaft portion by a rod extending laterally through said shaft, said mirror being mounted on said support member, such that rotation of said rod changes the orientation of said mirror and thereby the angle of said beam of light reflected through said opening.

13. The improvement claimed in claim 12, wherein said generator is supported within said hollow shaft portion at a position adjacent said mirror by a sleeve that also provides support for said support member, and further comprising a support housing located adjacent said second end of said shaft, and a feed cell for said generator supported in said housing and connected to said generator by a wire extending through said hollow shaft portion.

14. The improvement claimed in claim 1, further comprising a sleeve supporting said generator within said hollow shaft portion at a position adjacent said mirror, a support housing located adjacent said second end of said shaft, and a feed cell for said generator supported in said housing and connected to said generator by a wire extending through said hollow shaft portion.

* * * * *